US009960517B2

(12) United States Patent
Miled

(10) Patent No.: US 9,960,517 B2
(45) Date of Patent: May 1, 2018

(54) ELECTRICAL CONTACT TERMINAL HAVING A SPRING ELEMENT TO SUPPORT A CONTACT BEAM

(71) Applicant: Delphi International Operations Luxembourg S.A.R.L., Bascharage (LU)

(72) Inventor: Houssem Eddine Miled, Vitry-sur-Seine (FR)

(73) Assignee: Delphi International Operations Luxembourg SARL, Luxembourg (LU)

( * ) Notice: Subject to any disclaimer, the term of this patent is extended or adjusted under 35 U.S.C. 154(b) by 0 days. days.

(21) Appl. No.: 15/494,895

(22) Filed: Apr. 24, 2017

(65) Prior Publication Data

US 2017/0310033 A1 Oct. 26, 2017

(30) Foreign Application Priority Data

Apr. 25, 2016 (EP) ..... 16166801

(51) Int. Cl.

| | |
|---|---|
| ***H01R 13/11*** | (2006.01) |
| ***H01R 13/187*** | (2006.01) |
| ***H01R 13/193*** | (2006.01) |
| ***H01R 13/33*** | (2006.01) |
| ***H01R 43/16*** | (2006.01) |

(52) U.S. Cl.

CPC ..... *H01R 13/187* (2013.01); *H01R 13/11* (2013.01); *H01R 13/193* (2013.01); *H01R 13/33* (2013.01); *H01R 43/16* (2013.01)

(58) Field of Classification Search

CPC ..... H01R 4/22; H01R 4/4818; H01R 13/052; H01R 13/11; H01R 13/187; H01R 13/1973

USPC ..... 439/842, 843, 851, 852, 856, 857, 750

See application file for complete search history.

(56) References Cited

U.S. PATENT DOCUMENTS

| | | | | |
|---|---|---|---|---|
| 3,836,947 | A | 9/1974 | Yeager | |
| 6,547,608 | B2 * | 4/2003 | Sato | H01R 13/11 439/851 |
| 7,950,972 | B1 * | 5/2011 | Chen | H01R 13/111 439/852 |
| 2006/0035538 | A1 * | 2/2006 | Suemitsu | H01R 13/113 439/852 |

(Continued)

FOREIGN PATENT DOCUMENTS

FR 3027464 A1 4/2016

*Primary Examiner* — Chandrika Prasad
(74) *Attorney, Agent, or Firm* — Robert J. Myers

(57) ABSTRACT

An electrical contact terminal formed of sheet metal, an electrical connector comprising the terminal, and a method to manufacture the terminal is presented. The terminal includes a longitudinally extending cavity for receiving an electrical contact pin therein and a contact beam having a contact face arranged at least partially inside the cavity. The contact beam is configured to be deflected by the electrical contact pin to apply a contact force to the contact pin when the electrical contact pin is received in the cavity. The terminal further includes a flat support wall oriented substantially parallel to the insertion direction of the electrical contact pin. An aperture is formed proximate to an edge of the support wall to form a support spring element in the support wall. The support spring element is configured to engage with the contact beam when the same is deflected, thereby increasing contact force.

15 Claims, 4 Drawing Sheets

(56) References Cited

U.S. PATENT DOCUMENTS

2008/0070452 A1* 3/2008 Komiyama ..... H01R 13/113
439/852
2013/0288548 A1 10/2013 Amano et al.

* cited by examiner

ELECTRICAL CONTACT TERMINAL HAVING A SPRING ELEMENT TO SUPPORT A CONTACT BEAM

CROSS-REFERENCE TO RELATED APPLICATION

This application claims the benefit under 35 U.S.C. § 119(a) of Patent Application No. 16166801.7 filed in the European Patent Office on Apr. 25, 2016, the entire disclosure of which is hereby incorporated by reference.

TECHNICAL FIELD OF THE INVENTION

The invention relates to an electrical contact terminal having a support spring element and a method to manufacture the same.

BACKGROUND OF THE INVENTION

There is a trend in the art to provide electrical connectors having smaller dimensions, for e.g. providing multiple connectors in a restricted building space. However, with the electrical connectors becoming smaller and smaller, the electrically conductive inlays of those electrical connectors, i.e. the electrical contact pins and/or the electrical contact terminals, have to become smaller as well.

Wherein electrical contact pins can be manufactured with smaller dimensions (i.e. smaller cross section) very easily, it is more challenging to provide electrical contact terminals having smaller dimensions. The difficulties arise, since for providing smaller electrical contact terminals typically thinner metal sheets have to be used. However, providing electrical contact terminals being manufactured from thinner metal sheets, results in reduced wall thicknesses of the electrical contact terminal and thus to reduced contact forces that can be achieved between the electrical contact pin and the electrical contact terminal.

This is, because contact forces of an electrical contact terminal are typically generated by contact beams that are formed from a sheet of metal, wherein the contact beams are preferably integrally formed with the electrical contact terminal. Thus, the contact force that can be applied by a contact beam of an electrical contact terminal on an electrical contact pin is strongly dependent on the material used, i.e. the sheet material, and the sheet thickness. Consequently, with merely providing smaller terminals, the contact force applied on the electrical contact pin will become smaller. However, the smaller electrical contact terminals have to fulfill the same contact force requirements, i.e. they have to apply the same contact forces on the electrical contact pin, as electrical contact terminals that are manufactured from conventional thick sheet materials.

Generally, high contact forces are desired in electrical connectors (independent of the connector size), to provide a secure electrical contact between the electrical contact pin and the electrical contact terminal, since a higher contact force will reduce the contact resistance of the electrical contact. Further, with increasing the contact force, the connectors are less prone to environmental conditions, such as vibrations, shock and/or the like. Thus, the field of application of the connectors having a high contact force can be broadened.

In the art, electrical contact terminals 100 are known, as shown in FIG. 1, that are provided with a contact beam 120, being supported by a support beam 142, to provide increased contact forces between the electrical contact terminal 100 and the electrical contact pin 110 that can be received in the electrical contact terminal 100. Due to the stacked arrangement of the contact beam 120 and the support beam 142, both beams 120, 142 have to be deflected, when the pin 110 is received in the electrical contact terminal 100, thereby increasing the contact force $F_N$. However, in the known electrical contact terminal 100, the contact force is directly dependent on the sheet material thickness used. Thus, the required contact force limits the minimal sheet thickness so that terminals being provided with stacked contact and support beams 120, 142 cannot be provided at very small dimensions. Respectively, if thin sheets are used, the required contact force cannot be achieved.

Further, in order to increase the contact force, different sheet materials can be used, particularly sheet materials having a high stiffness, resulting in stiff electrical contact terminals. These stiff electrical contact terminals can generate high contact forces on an electrical contact pin, received therein. However the contact force will increase rapidly with increased deflection of the contact and/or support beam(s), e.g. due to variations of the dimensions of the electrical contact pins used. Therefore the contact force and the pin insertion force, i.e. the force that is required to insert an electrical contact pin into the electrical contact terminal, strongly depend on the dimensions of the electrical contact pin. This is not desirable, since a certain contact force has to be achieved. Further, varying pin insertion forces make automated pin insertion and surveillance more difficult. Particularly, high pin insertion forces hinder the insertion of the electrical contact pin and increase the risk of damaging the electrical contact pin and/or the electrical contact terminal during pin insertion.

Still further, using stiff contact terminals results in high stress levels, particular at the contact and support beams. If an electrical contact pin is inserted improvidently, e.g. due to high required pin insertion forces, the terminal can be damaged, e.g. by plastic deformation.

Therefore, there is a need in the art to provide electrical contact terminals that can provide a high contact force, even if small dimensions of the terminal are required. Further, the electrical contact terminals shall be configured to provide a desired high contact force, while pin insertion forces are moderate. Still further, the contact force and/or the pin insertion force shall have small tolerances.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

Particularly, the objects described above are solved by an electrical contact terminal made from bend and cut sheet metal, comprising: a longitudinally extending cavity for receiving an electrical contact pin therein; a contact beam, having a contact face arranged at least partially inside the cavity, wherein the contact beam is configured to be deflected by the electrical contact pin to apply a contact force to the contact pin, when the electrical contact pin is received in the cavity, and a flat support wall being oriented substantially parallel to the insertion direction A of the electrical contact pin into the cavity, wherein an aperture is formed in proximity to an edge of the flat support wall to form a support spring element in the flat support wall, wherein the support spring element is configured to engage with the contact beam, when the same is deflected, to increase the contact force $F_N$.

The contact beam that is arranged at least partially within the cavity for receiving the electrical contact pin, will apply a contact force onto the electrical contact pin, when the same is received within the cavity. Preferably, the contact beam comprises a spring portion that is designed to be deflected and to provide a first level of contact force $F_N$ onto the electrical contact pin. The support spring element that is configured to engage with the contact beam will increase the contact force $F_N$ that is applied via the contact beam onto the electrical contact pin. Thus, a desired high contact force $F_N$ can be applied onto the electrical contact pin.

For example, a small first level of contact force $F_N$ is applied onto the electrical contact pin in a first insertion phase. This first insertion phase corresponds to an insertion path x of the electrical contact pin into the cavity, wherein the electrical contact pin contacts the contact beam of the electrical contact terminal, but the electrical contact beam does preferably not yet engage with the support spring element. Alternatively, the support spring element can be engaged with the contact beam, even if no electrical contact pin is inserted in the cavity. In a second insertion phase, the support spring element engages with the contact beam, due to the deflection of the contact beam and applies an increased contact force via the contact beam onto the electrical contact pin.

Since the contact force applied onto the electrical contact pin and the pin insertion force, i.e. the force that is required to insert the electrical contact pin into the cavity of the terminal, are dependent, the insertion force will preferably gradually increase during the first and second insertion phase. Thus, an electrical contact pin can be inserted into the electrical contact terminal starting with a small insertion force and, when the electrical contact pin is guided by the electrical contact terminal, due to a desired insertion path x, the insertion force and the corresponding contact force can be increased. Hence, the risk of damaging the electrical contact pin and/or the electrical contact terminal during the insertion of the electrical contact pin can be significantly reduced.

Further, with providing the support spring element in the flat support wall, which is oriented substantially parallel to the insertion direction A of the electrical contact pin into the cavity, the achievable contact force $F_N$, is not dependent of the sheet thickness of the flat support wall. The achievable contact force $F_N$ is rather dependent on the shape and design of the aperture formed in proximity to an edge of the flat support wall and the shape and design of the resulting support spring element. For example, if the aperture is formed farther from the edge of the flat support wall, the support spring element will have an increased width and therefore, will be stiffer. If the aperture is formed closer to the edge of the support wall, the resulting support spring element is less stiff and therefore, the contact force $F_N$ will be lower.

The edge of the flat support wall can be a straight edge or a curved edge, wherein a curved edge is preferably provided as a convex curved edge. Further, the edge can be initially a straight edge and after forming the aperture, e.g. by stamping, the edge can have a curved shape, such as a convex curved shape.

Depending on the shape of the aperture, formed in the support wall, the internal stresses of the terminal can be lowered. Particularly, since the support spring element is elastically deformed or deflected during the insertion of the electrical contact pin into the electrical contact terminal, stresses, such as bending stresses, will occur. With providing a suitable aperture shape, such as a shape having a rounded corner, the stresses can be reduced. Generally, the aperture can have any desirable form, such as a rectangular form, an elliptical form, a polygonal form, wherein a corner of the shape is provided preferably rounded.

Depending on the orientation of the flat support wall relative to the contact beam, the support spring element will be deflected in the sheet plane of the flat support wall, or not. For example, if the flat support wall is oriented parallel to a deflection plane of the contact beam, the deflection direction of the support spring element will be in the sheet plane of the flat support wall.

The contact beam can be configured to be deflected by the electrical contact pin in a deflection plane, and the flat support wall can be oriented parallel to the deflection plane.

The deflection of the contact beam is typically a pivot movement that is carried out in a deflection plane. As the flat support wall is oriented (i) parallel to the deflection plane, and (ii), as previously described, substantially parallel to the insertion direction A, the flat support wall is oriented substantially perpendicular to the contact beam. That means that the deflection direction of the support spring element and the deflection direction of the contact beam are arranged in deflection planes that are substantially parallel to each other. In other words, the support spring element will be deflected by the contact beam during the insertion of the electrical contact pin in a plane that corresponds to the main plane of the flat support wall. Since the flat support wall is typically manufactured from a metal sheet, the deflection direction of the support spring element lays within the sheet plane.

Thus, the achievable contact force and the stiffness of the support spring element are particularly dependent on the shape and design of the aperture formed in proximity to an edge of the flat support wall and the position of the aperture relative to the edge. This allows a high design flexibility and to configure the electrical contact terminal to meet different requirements. For example, contact terminals can be achieved that allow high contact forces that vary minimally with respect to tolerances of the electrical contact pin that is received within the cavity of the electrical contact terminal.

The aperture can comprise an essentially closed rim to form the support spring element, comprising a single support spring arm that is configured to engage with the corresponding contact beam, to increase the contact force.

If the aperture is provided with a closed rim to form the support spring element, the support spring element is connected at two points with the flat support wall. Thus, the support spring element functions similarly to a leaf spring. I.e. the contact forces applied by the contact beam onto the electrical contact pin are guided via two coupling points into the flat support wall. This allows the application of high contact forces, of at least 3 N, preferably of at least 6 N, even more preferably of at least 9 N and most preferably of at least 12 N.

An essentially closed rim of the aperture will lead to a gap, provided in the flat support wall. The gap can either be arranged in a region of the flat support wall that does not form the support spring element, so that the resulting supporting spring arm is connected to a divided flat support wall at two points. Alternatively, the gap can be provided in proximity to one of the connection points of the support spring element, so that a single support spring arm is provided that can deflect freely at a distal end. The gap can be arranged in proximity to the pin insertion opening of the terminal or opposite thereto. An essentially closed rim, i.e. a rim having a gap, leads to decreased stiffness and therefore to higher allowable tolerances for the dimensions of the electrical contact pin.

The aperture can further comprise an open rim, to form a spring element, comprising a primary support spring arm and a secondary support spring arm, wherein the primary support spring arm and/or the secondary support spring arm are configured to engage with the corresponding contact beam, to increase the contact force.

An open rim, dividing the spring element into a primary support spring arm and a secondary support spring arm via a gap, allows the establishment of a gradually increasing contact force during the insertion of the electrical contact pin into the cavity of the electrical contact terminal. Thus, the contact force and in particular the pin insertion force can be configured. Besides the shape of the aperture and the width of the gap formed between the support spring arms, the length and width of the support spring arms defines the achievable contact force. If the support spring arms are designed to engage with the contact beam subsequently, a gradually increasing contact force and pin insertion force can be achieved. Particularly, the support spring arms can have the same length.

Likewise, the primary support spring arm and the secondary support spring arm can have different lengths, wherein the primary support spring arm, arranged farther form a pin insertion opening of the electrical contact terminal, is preferably longer than the secondary support spring arm, arranged closer to the pin insertion opening of the electrical contact terminal.

Providing a longer primary support spring arm allows the provision of a gradually increasing contact force and/or pin insertion force, particularly without steep rising contact forces and/or pin insertion forces. For example, the electrical contact terminal can be designed so that upon insertion of an electrical contact pin into the cavity, the pin first comes into contact with the contact beam, which applies a first level of contact force onto the electrical contact pin. During this first insertion phase, i.e. the insertion phase, when the electrical contact pin first contacts the contact beam, the contact beam is deflected and applies a rising contact force onto the electrical contact pin. In a second insertion phase, the contact beam engages with the primary support spring arm. Upon further insertion of the electrical contact pin, the contact beam is deflected together with the primary support spring arm, wherein a higher rising contact force is applied onto the electrical contact pin. In a third insertion phase, the contact beam further engages with the secondary support spring arm, so that on further insertion of the electrical contact pin, the contact beam, the primary support spring arm and the secondary support spring arm are deflected. Thus, the contact force further increases. With increasing contact force, also the pin insertion force will rise. However, since the contact force gradually increases, the pin insertion force rises after the electrical contact pin has achieved a certain pin insertion depth, i.e. the electrical contact pin is guided by the cavity and the risk of damage of the electrical contact pin and/or the electrical contact terminal can be reduced.

Alternatively to the previously described deflectable support spring arms, one or both of the support spring arms can be provided in a stiff manner, e.g. by reducing the length of the support spring arm, so that the support spring arms are not or just minimally deflected, when engaging with the contact beam. In this case, the increase in contact force is primarily achieved by providing additional support points for the contact beam, so that the deflectable length of the contact beam is shortened. This results in a higher contact force that can be applied.

The primary support spring arm and the secondary support spring arm can further have different lengths, wherein one support spring arm is at least twice as long, preferably at least three times as long, and even more preferably at least 5 times as long as the respective other support spring arm. This allows providing support spring arms having a different stiffness and thereby configuring the pin insertion force and contact force profile.

The primary support spring arm and the secondary support spring arm can be arranged, so that during insertion of an electrical contact pin into the cavity, the primary support spring arm is configured to first engage with a corresponding contact beam, and the secondary support spring arm is configured to engage subsequently with the corresponding contact beam.

As previously described, the subsequent engagement of the contact beam with the support spring arms (cf. second and third insertion phases), results in a gradually increased contact force and/or a gradually increased insertion force. In particular, the insertion force can be kept low in the beginning of the insertion and will increase when the insertion of the electrical pin has achieved a certain insertion depth, so that the electrical contact pin is securely guided by the cavity. Thus, the risk of damaging the electrical contact pin and/or the electrical contact terminal can be significantly reduced.

The aperture can have a substantially elliptical shape. A substantially elliptical shape is preferred, since stresses occurring during the insertion of the electrical contact pin, i.e. by means of deflection, can be significantly reduced. Thus, a plastic deformation is prevented and the life span of the electrical contact terminal can be prolonged.

Further, the contact beam can comprise an engaging face, wherein the support spring element is configured to engage with the engaging face of the corresponding contact beam to increase the contact force $F_N$, wherein the engaging face is preferably arranged opposite to the contact face of the corresponding contact beam.

Providing an engaging face allows a directed and locally defined force transmission of the contact force $F_N$. Further, if the engaging face is arranged opposite to the contact face of the corresponding contact beam, the contact force $F_N$ can be transmitted directly via the support spring element to the support wall. Thus, the stress occurring in the contact beam can be reduced.

The support spring element and the corresponding contact beam can extend along the insertion direction A of the electrical contact pin into the cavity, wherein the support spring element can be arranged symmetrical to the corresponding contact beam.

The symmetrical arrangement of the support spring element and the contact beam prevents an undesired twisting of the contact beam and/or the support spring element if an electrical contact pin is inserted into the cavity. Thus, stresses occurring in the contact beam and/or the support spring element can be further reduced.

The geometrical shape of the support spring element can be designed to provide a contact force $F_N$ of at least 2 N, preferably of at least 4 N and even more preferably of at least 7 N. If an aperture having a closed rim is provided, the achievable contact force $F_N$ can be higher, as discussed above. Those contact forces $F_N$ have to be shown to be sufficient to provide a secure electrical contact between the electrical contact terminal and the electrical contact pin even under rough environmental conditions, such as vibration, shock and/or the like.

The electrical terminal can have a width of at most 1.8 mm, preferably of at most 1.4 mm and even more preferably of at most 1 mm, and a height of at most 2.3 mm, preferably of at most 1.9 mm, and even more preferably of at most 1.6 mm.

Providing small dimensions, while still allowing the application of high contact forces, allows the fabrication of micro terminals. In particular, with providing small terminals, multiple contact terminals can be arranged within a small building space, allowing to provide high dense electrical connectors. This is particularly preferred in applications having challenging space requirements, such as automotive applications and/or the like.

The electrical contact terminal can be formed from a metal sheet, having a thickness of at most 0.2 mm, preferably of at most 0.17 mm and even more preferably of at most 0.15 mm. The electrical contact terminal is preferably integrally formed as one part. These sheet thicknesses are preferred if electrical contact terminals with small dimensions and/or high contact forces are provided. Integrally forming the terminal as one part allows reduction of manufacturing costs.

The electrical contact terminal can comprise a further contact portion being integrally formed with an inner wall of the cavity, which further contact portion protrudes into the cavity and is configured to contact an opposite side of the electrical contact pin as contacted by the contact beam, when the electrical contact pin is received in the cavity.

A further contact portion will improve the electrical contact between the electrical contact terminal and the electrical contact pin. Particularly, if the further contact portion is arranged opposite to the electrical contact beam, a further design option is given to establish a desired high contact force. For example, if the contact portion is an elastic contact portion, higher tolerances of the dimensions of the electrical contact pin can be allowable, with respect to applied contact force. The further contact portion can be provided in form of protrusions as well as in form of contact beams and/or contact spring elements.

The object is further solved by an electrical connector assembly, comprising a connector housing, and an electrical contact terminal as previously described.

If the above-described electrical contact terminal(s) is/are provided within a connector housing, an electrical connector assembly can be provided, having an improved high contact force. Further, high dense electrical connectors can be provided that have multiple electrical terminals and/or electrical contact pins on a restricted construction space.

The object is still further solved by a method to manufacture an electrical contact terminal as previously described, wherein the method comprises the following steps:

cutting a preform from a metal sheet, wherein the cutting is preferably performed with a stamping tool, wherein the preform comprises a preform of a contact beam, a preform of a flat support wall, wherein an aperture is formed in proximity to an edge of the flat support wall to build a support spring element, and a preform of a terminal body, wherein the preforms are preferably integrally formed, and bending the preforms to achieve: a longitudinally extending cavity, for receiving an electrical contact pin therein; a contact beam, having a contact face, arranged at least partially inside the cavity, wherein the contact beam is configured to be deflected by the electrical contact pin to apply a contact force to the contact pin, when the electrical contact pin is received in the cavity, and a support side wall, being oriented substantially parallel to the insertion direction A of the electrical contact pin into the cavity, wherein the support spring element is configured to engage with the contact beam, when the same is deflected, to increase the contact force $F_N$.

The above-described method to manufacture the electrical contact terminal provides a fast and cost-effective method to manufacture electrical contact terminals. Particularly, if the cutting is performed by stamping, the pre-form can preferably be built in a single manufacturing step. Still further, if the pre-forms are formed as an integrally formed part, manufacturing costs can be significantly reduced, since a subsequent assembly of the pre-forms can be prevented. The subsequent bending of the pre-forms to achieve the final shape of the electrical contact terminal can be fully automated, though these very cost-effective terminals can be produced.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
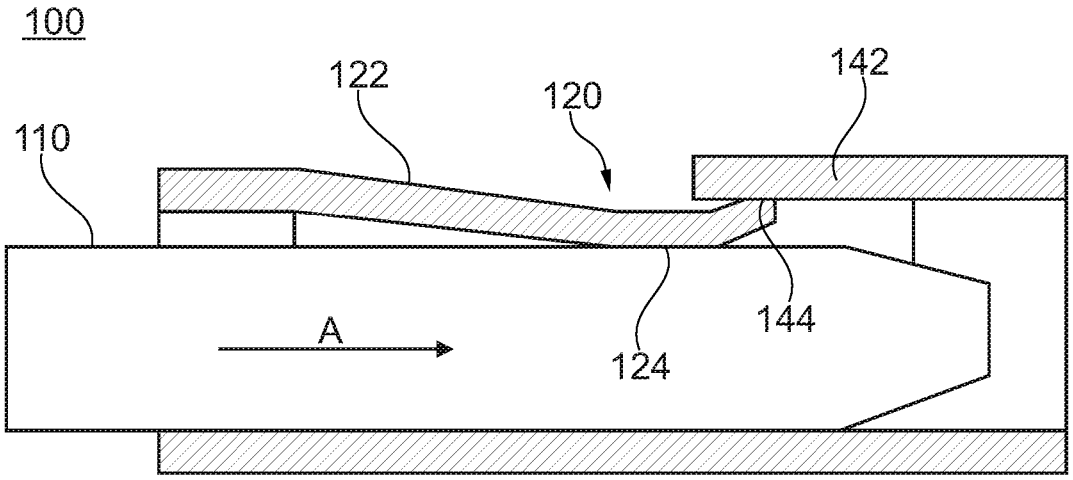
(Prior Art) Fig. 1
FIG. 1 illustrates a schematic cut view of an electrical contact terminal, according to the prior art.

In particular, FIG. 1 shows an electrical contact terminal 100 according to the prior art. In these known electrical contact terminals 100, an electrical contact pin 110 can be inserted into the electrical contact terminal 100 along an insertion direction A, indicated by arrow A. Upon insertion, the electrical contact pin 110 will come into contact with the contact beam 120. The contact beam 120 comprises a spring portion 122 and a contact face 124. The contact face 124 contacts the electrical contact pin 110 to establish an electrical contact and to apply a contact force $F_N$ onto the electrical contact pin 110. Upon insertion of the electrical contact pin 110, the spring portion 122 of the contact beam 120 is deflected. In order to increase the contact force that is achievable, a support beam 142 is provided. The support beam 142 is a portion of the electrical contact terminal and e.g. integrally formed therewith. The support beam 142 comprises an engaging face 144 for engaging with the electrical contact beam 120. When the contact beam 120 is deflected, it engages with the engaging face 144 of the support beam 142, resulting in an increased contact force on the electrical contact pin 110. As can be seen from FIG. 1, the contact beam 120 as well as the support beam 142 are arranged in a stacked manner, wherein their thickness corresponds to the sheet thickness of the electrical contact terminal 100. Thus, the achievable contact force $F_N$ is limited by the maximum sheet thickness. Further, due to the design of the support beam 142, so terminals tend to be very stiff and therefore vary in the achievable contact force depending on the dimensional tolerances of the inserted electrical contact pin 110.

Figure 2A:
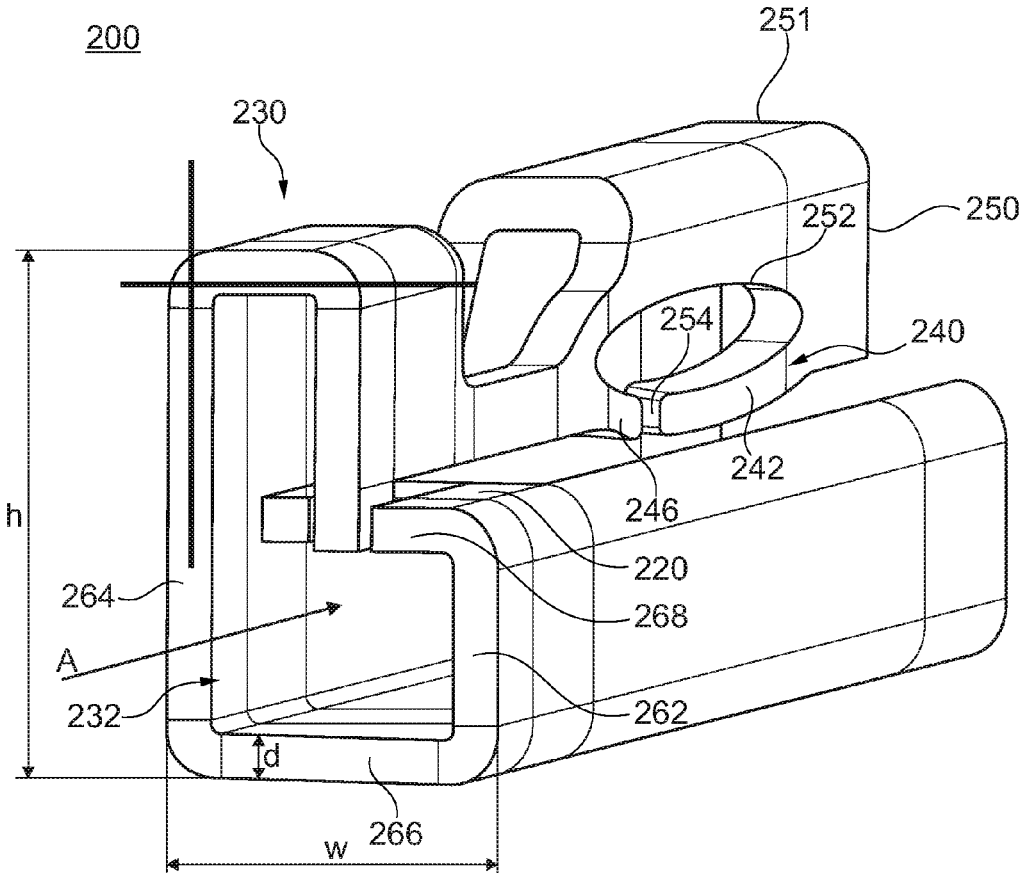
FIG. 2A illustrates a schematic perspective view of an electrical contact terminal according to one embodiment.
Figure 2B:
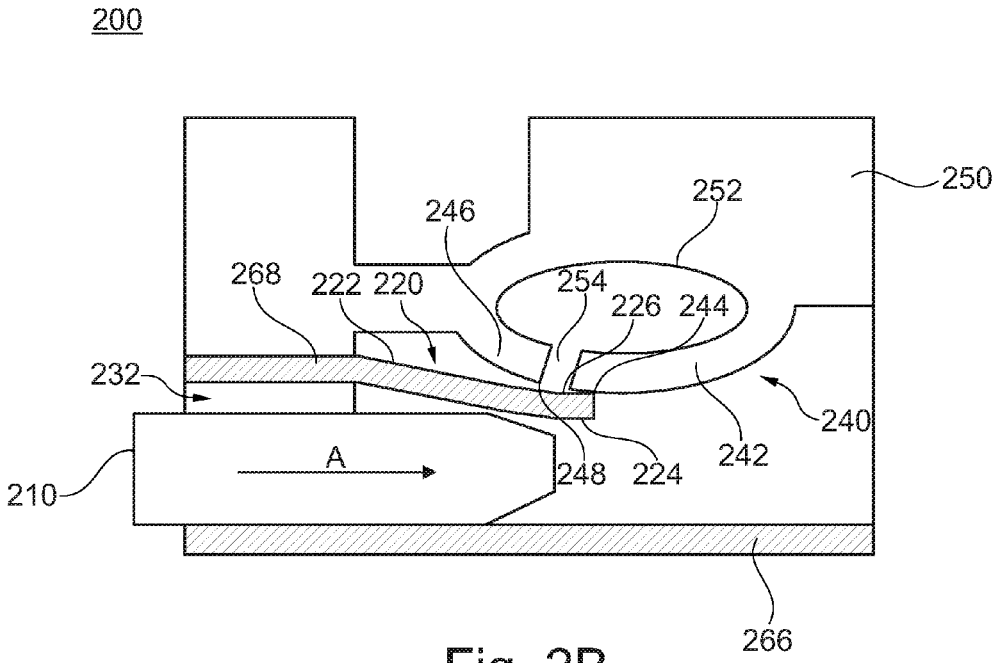
FIG. 2B illustrates a schematic cut view of an electrical contact terminal according to one embodiment.
Figure 2C:
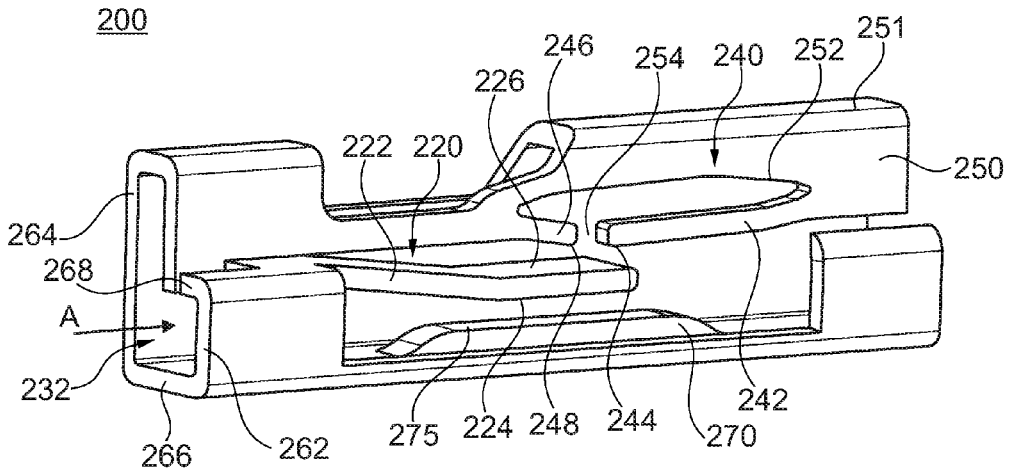
FIG. 2C illustrates a schematic partially cut view of an electrical contact terminal according to one embodiment.

FIGS. 2A-2C show an embodiment of an electrical contact terminal 200 that is provided with a support spring element 240, comprising an aperture 252 having an open rim. In the respective figures, same reference signs are used for same parts.

FIG. 2A shows a schematic perspective view of an electrical contact terminal 200. The terminal has a width w of approximately 1 mm to 1.8 mm and a height h of approximately 1.5 mm to 2.3 mm. The sheet thickness d is preferably in the range of at most 0.2 mm to at most 0.15 mm. The electrical contact terminal 200 is preferably formed from an integrally formed pre-form being cut from a metal sheet. The cutting is preferably performed with a stamping tool. After cutting, the pre-form is bent to the shape shown in FIG. 2A building an electrical contact terminal 200.

The electrical contact terminal 200 comprises a pin-receiving cavity 232 that is restricted by a bottom wall 266 and an opposite top wall 268. Laterally, the pin-receiving cavity 232 is restricted by a first side wall 262 and a second side wall 264. The second side wall 264 extends over the top wall 268 and is connected via a support top wall 268 with the flat support wall 250. The top wall 268 is connected with a contact beam 220 as best shown in FIGS. 2B and 2C.

In the flat support wall 250, an aperture 252 is formed in proximity to an edge of the flat support wall 250, which edge has a convex curved shape. Thus, a support spring element 240 is formed. Since the aperture 252 comprises an open rim, the support spring element 240 is divided by gap 254 into two support spring arms 242, 246. The support spring arm 242, which is a primary support spring arm 242, is longer than the support spring arm 246, which is a secondary support spring arm 246.

The electrical contact terminal 200 allows providing increased contact forces, while the terminal body 230, respectively the electrical contact terminal 200, is less stiff and stress-optimized, so that tolerances of the dimensions of the electrical contact pin 210 that can be inserted into the pin-receiving cavity 232 will not lead to significantly varying contact and pin insertion forces.

FIG. 2B shows a schematically cut view of the electrical contact terminal 200 of FIG. 2A. FIG. 2B further shows an electrical contact pin 210 that is inserted into the pin-receiving cavity 232 in order to establish an electrical contact between the electrical contact terminal 200 and the electrical contact pin 210. Upon insertion, the electrical contact pin 210 will come into contact with a contact face 224 of a contact beam 220. The contact beam 220 comprises a spring portion 222 that interconnects the top wall 268 with the contact face 224. Due to the spring portion 222, the contact beam 220 is deflectable and can apply a contact force onto the electrical contact pin 210. Parallel to the insertion direction A, a flat support wall 250 is arranged. The flat support wall 250 comprises an aperture 252, being formed in the flat support wall 250 in proximity to an edge of the flat support wall 250, thereby forming a support spring element 240. Since the aperture 252 comprises an open rim, the support spring element 240 is divided via gap 254 into two support spring arms 242, 246, i.e. a primary support spring arm 242 and a secondary support spring arm 246.

The primary support spring arm 242 is arranged farther from the pin insertion opening of the electrical contact terminal 200 and is longer than the secondary support spring arm 246. Preferably, the primary support spring arm 242 is at least twice as long, even more preferably at least three times as long and even more preferably at least five times as long as the secondary support spring arm 246. Upon insertion of the electrical contact pin 210, the electrical contact pin 210 will in a first insertion phase I, contact the contact beam 220 at the contact face 224 and deflect the contact beam 220. Then, the contact beam 220 engages in a second insertion phase II with the primary support spring arm 242 at a primary support face 244. Preferably, the engagement occurs at an engaging face 226 of the contact beam 220. Due to the engagement, the primary support spring arm 242 is deflected and the contact force onto the electrical contact pin 210 is increased. In a third insertion phase III, the contact beam 220 is further deflected, so as to engage with the secondary support spring arm 246 to further increase the contact force. The secondary support spring arm 246 comprises a support face 248 to engage with the engaging face 226 of the contact beam 220. The contact force applied onto the electrical contact pin during the insertion phases I, II and III is discussed in greater detail with reference to FIG. 4.

FIG. 2C shows a partially cut view of an electrical contact terminal 200, wherein a further contact portion 270 is provided integrally formed with the bottom wall 266 of the electrical contact terminal 200. The reference signs used in FIG. 2C correspond to the reference signs used in FIGS. 2A and 2B. The further contact portion 270 comprises a contact face 275 that will contact an electrical contact pin 210 at a position opposite to the position, where the contact face 224 of the electrical contact pin 210 contacts the electrical contact pin 210 upon insertion. With providing a further contact portion 270, the contact force can be further increased. Further, the engaging face 226 for engaging the contact beam 220 with the primary and secondary support spring arms 242, 246 is arranged opposite to the contact face 224. Thus, the contact force that is applied onto the electrical contact pin 210 can be transferred directly to the support spring arms 242, 246 and further to the flat support wall 250.

Figure 3:
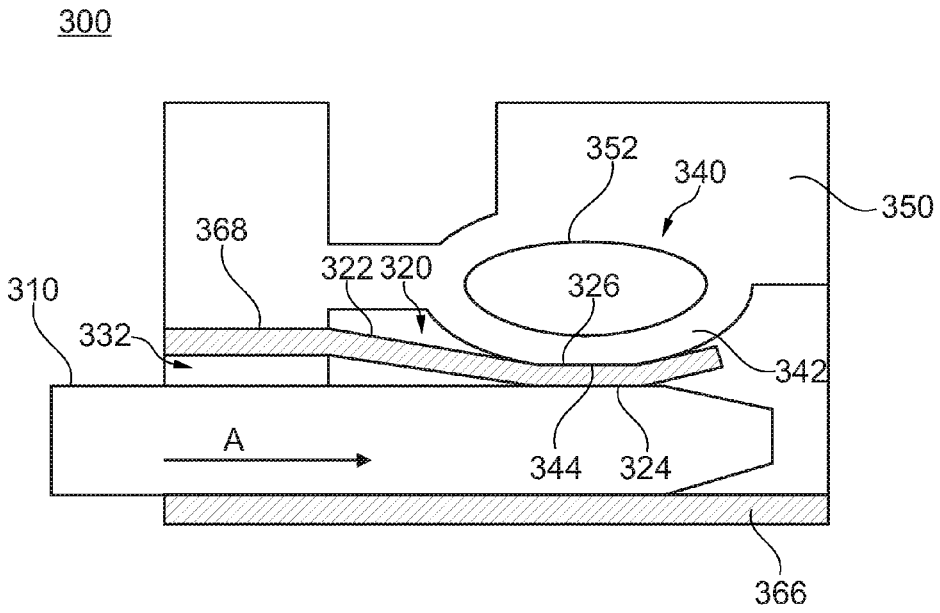
FIG. 3 illustrates a schematic cut view of an electrical contact terminal according to another embodiment.

FIG. 3 shows a schematic cut view of a further embodiment of an electrical contact terminal 300. The design and shape of the electrical contact terminal 300 corresponds in particular to the design and shape of the electrical contact terminal 200 described with respect to FIGS. 2A-2C. However, the embodiment shown in FIG. 3 distinguishes from the embodiment shown in FIGS. 2A-2C in that the aperture 352 formed in the flat support side wall 350 comprises a closed rim. In detail:

The electrical contact terminal 300 comprises a pin insertion cavity 332 that is configured to receive an electrical contact pin 310 in the pin insertion direction A. Upon insertion, the electrical contact pin 310 will contact a contact beam 320 at a contact face 324. The contact beam 320 comprises a spring portion 322 to apply a contact force $F_N$ onto the electrical contact pin 310. The spring portion 322 interconnects the contact face 324 with a top wall 368 of the pin insertion cavity 332. The top wall 368 lays opposite to a bottom wall 366. Further, a flat support side wall 350 is provided that is arranged substantially parallel to the pin insertion direction A.

Further, an aperture 352, having a closed rim, is formed in proximity to an edge of the flat support side wall 350 to form a support spring element 340. The support spring element 340 comprises a single support spring arm 342 that is connected with the support spring wall 350 at two points and functions similarly to a leaf spring. The support spring arm 342 is provided with a support face 344 that engages with an engaging face 326 of the contact beam 320, when the contact beam 320 is deflected. Thus, the contact force applied via the contact beam 320 onto the electrical contact pin 310 can be increased. In will be understood that in the embodiments shown in FIGS. 2A-3, the contact beams 220, 320 can engage with the respective support spring elements 240, 340, respectively the support spring arms 242, 246, 342, even before inserting the electrical contact pin 210, 310 into the cavity, i.e. before the contact beams 220, 320 are deflected.

Figure 4:
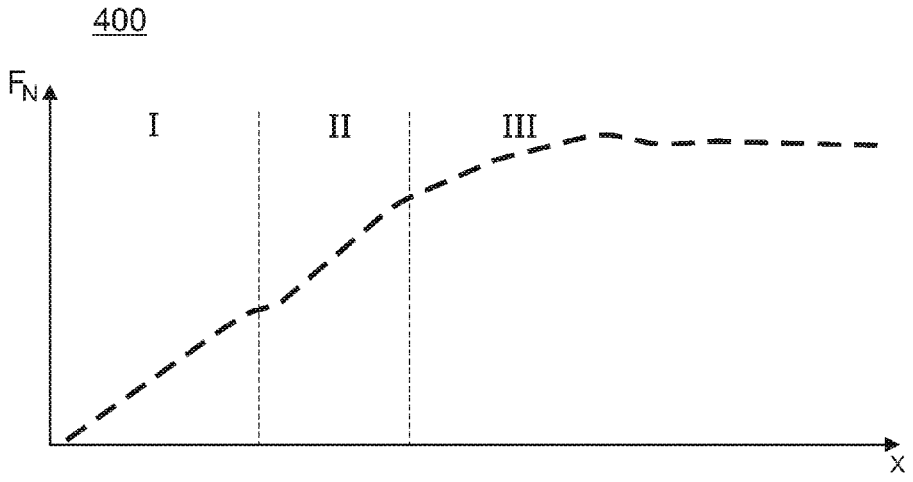
FIG. 4 illustrates a schematic insertion force/insertion path diagram of the electrical contact terminal of FIGS. 2A-2C.

FIG. 4 shows a schematic contact force/insertion path diagram of an electrical contact terminal, such as electrical contact terminal 200. The insertion path x corresponds to the insertion depth of an electrical contact pin 210 into an electrical contact terminal 200, as shown in FIGS. 2A to 2C. The contact force $F_N$ corresponds to the normal force applied via the contact beam 220 and/or the support spring arm(s) 242, 246 onto the electrical contact pin 210. In a first insertion phase I, the electrical contact pin 210 contacts the contact beam 220, wherein the contact beam 220 is not yet in contact with a support spring arm 242, 246. With increasing insertion depth, the contact force $F_N$ applied onto the electrical contact pin 210 increases, but would not exceed beyond the contact force level that is achieved at the end of pin insertion phase I.

At the end of pin insertion phase I, the deflected contact beam 220 engages with the primary support spring arm 242. Due to the engagement, the contact beam 220 and the primary support spring arm 242 are deflected, so that the contact force rises further to a certain level, achieved at the end of insertion phase II. At the end of insertion phase II, the deflected contact beam 220 engages with the secondary support spring arm 246. Thus, the contact force can be further increased. After a certain insertion depth, the contact force remains constant. Thus, the contact force can be gradually increased over the insertion phases I, II, III in order to provide a desired high contact force.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

I claim:

1. An electrical contact terminal, comprising:

a longitudinally extending cavity for receiving an electrical contact pin therein;

a contact beam, having a contact face arranged at least partially inside the cavity, wherein the contact beam is configured to be deflected by the electrical contact pin to apply a contact force to the electrical contact pin when the electrical contact pin is received in the cavity, and a flat support wall oriented substantially parallel to an insertion direction of the electrical contact pin into the cavity, wherein an aperture is formed proximate to an edge of the flat support wall to form a support spring element in the flat support wall and wherein the support spring element is configured to engage with the contact beam when the support spring element is deflected, thereby increasing the contact force.

2. The electrical contact terminal according to claim 1, wherein the contact beam is configured to be deflected by the electrical contact pin in a deflection plane and wherein the flat support wall is oriented parallel to the deflection plane.

3. The electrical contact terminal according to claim 1, wherein the aperture comprises an essentially closed rim to form the support spring element and wherein the support spring element is a single support spring arm configured to engage with the contact beam, thereby increasing the contact force.

4. The electrical contact terminal according to claim 1, wherein the aperture comprises an open rim to form a spring element and wherein the support spring element comprises a primary support spring arm and a secondary support spring arm, wherein the primary support spring arm and/or the secondary support spring arm are configured to engage with the contact beam, thereby increasing the contact force.

5. The electrical contact terminal according to claim 4, wherein the primary support spring arm and the secondary support spring arm have different lengths and wherein the primary support spring arm, arranged farther form a pin insertion opening of the electrical contact terminal, is longer than the secondary support spring arm, arranged closer to the pin insertion opening of the electrical contact terminal.

6. The electrical contact terminal according to claim 4, wherein the primary support spring arm and the secondary support spring arm have different lengths, and wherein one support spring arm is at least twice as long as the other support spring arm.

7. The electrical contact terminal according to claim 4, wherein the primary support spring arm and the secondary support spring arm are arranged such that the primary support spring arm is configured to first engage with a corresponding contact beam and the secondary support spring arm is configured to engage subsequently with the corresponding contact beam during insertion of the electrical contact pin into the cavity.

8. The electrical contact terminal according to claim 1, wherein the aperture has a substantially elliptical shape.

9. The electrical contact terminal according to claim 1, wherein the contact beam comprises an engaging face, wherein the support spring element is configured to engage with the engaging face of the contact beam to increase the contact force, and wherein the engaging face is preferably arranged opposite to the contact face of the contact beam.

10. The electrical contact terminal according to claim 1, wherein the support spring element and the contact beam extend along the insertion direction of the electrical contact pin into the cavity and wherein the support spring element is arranged symmetrical to the contact beam.

11. The electrical contact terminal according to claim 1, wherein the geometrical shape of the support spring element is designed to provide the contact force of at least 1 N.

12. The electrical contact terminal according to claim 1, wherein the electrical contact terminal has a width of at most 1.8 mm and a height of at most 2.3 mm.

13. The electrical contact terminal according to claim 1, wherein the electrical contact terminal is formed from a metal sheet having a thickness of at most 0.2 mm and wherein the electrical contact terminal is preferably integrally formed as one part.

14. The electrical contact terminal according to claim 1, wherein the electrical contact terminal comprises a further contact portion being integrally formed with an inner wall of the cavity which further contact portion protrudes into the cavity and is configured to contact an opposite side of the electrical contact pin as contacted by the contact beam, when the electrical contact pin is received in the cavity.

15. An electrical connector assembly, comprising:

a connector housing, and an electrical contact terminal according to claim 1.

* * * * *